US009482049B2

(12) United States Patent
Chen

(10) Patent No.: US 9,482,049 B2
(45) Date of Patent: Nov. 1, 2016

(54) CURTAIN BODY LOCATING MECHANISM OF A CURTAIN WITH NO CORD

(71) Applicant: Chin-Fu Chen, Taichung (TW)

(72) Inventor: Po-Yu Chen, Taichung (TW)

(73) Assignee: Chin-Fu Chen, Taichung (TW)

( * ) Notice: Subject to any disclaimer, the term of this patent is extended or adjusted under 35 U.S.C. 154(b) by 121 days.

(21) Appl. No.: 14/617,335

(22) Filed: Feb. 9, 2015

(65) Prior Publication Data

US 2016/0230454 A1 Aug. 11, 2016

(51) Int. Cl.
*E06B 9/30* (2006.01)
*E06B 9/322* (2006.01)

(52) U.S. Cl.
CPC ..... *E06B 9/322* (2013.01); *E06B 2009/3222* (2013.01)

(58) Field of Classification Search
CPC . E06B 9/322; E06B 9/325; E06B 2009/3222
See application file for complete search history.

(56) References Cited

U.S. PATENT DOCUMENTS 6,318,661 B1 11/2001 Martin et al.
7,025,107 B2 4/2006 Ciuca
8,893,763 B2 * 11/2014 Huang ..... E06B 9/322 160/170
9,127,500 B2 * 9/2015 Huang ..... E06B 9/322
2006/0278348 A1 * 12/2006 Huang ..... E06B 9/322 160/170
2014/0083631 A1 * 3/2014 Huang ..... E06B 9/322 160/170
2014/0224431 A1 * 8/2014 Lin ..... A47H 5/032 160/84.01
2014/0291431 A1 * 10/2014 Huang ..... E06B 9/322 242/372

* cited by examiner

*Primary Examiner* — Sang Kim
(74) *Attorney, Agent, or Firm* — Muncy, Geissler, Olds & Lowe, P.C.

(57) ABSTRACT

A curtain body locating mechanism of a curtain with no cord mainly utilizes two separation and reunion units to control the locating effect when a curtain body is being spread or folded. The separation and reunion unit comprises an axle, two braking blocks, a separation and reunion wheel and two planetary gears. The two braking blocks are spaced apart and connected to the periphery of the axle so that a rolling groove is formed between the two braking blocks. The separation and reunion wheel is nested onto the axle and has an inner ring gear surrounding the two braking blocks. Each of the planetary gears is disposed within one of the rolling grooves and engaged with the inner ring gear of the separation and reunion wheel.

5 Claims, 6 Drawing Sheets

CURTAIN BODY LOCATING MECHANISM OF A CURTAIN WITH NO CORD

BACKGROUND OF THE INVENTION

1. Technical Field

The present invention relates to a curtain with no cord, and more particularly, to a curtain body locating mechanism for use in a curtain with no cord.

2. Description of Related Art

Generally, curtains can be divided structurally into curtains with cord and curtains with no cord. For the curtains with cord, a user mainly utilizes a cord to drive the curtain body to be spread or folded; and for the curtains with no cord, the user uses his/her hand to pull down or push up a lower beam so as to spread or fold the curtain body.

However, although curtains with no cord allow users to spread or fold the curtain body easily, the curtain body is likely to rise again automatically after being fully spread or sag automatically after being fully folded due to the lack of a good locating design in structure, and this will make the practical operation troublesome for the users.

BRIEF SUMMARY OF THE INVENTION

A primary objective of the present invention is to provide a curtain body locating mechanism for use in a curtain with no cord which has a simple structure and can provide good locating effect so as to make the operation more convenient.

To achieve the aforesaid objective, the curtain body locating mechanism of the present invention comprises a base, two coil spring wheels, a coil spring, two cord wheels, two separation and reunion units and two cords. The coil spring wheels are disposed on the base rotatably and engaged with each other. The coil spring is connected to the two coil spring wheels and optionally winded onto one of the coil spring wheels so that the two coil spring wheels can rotate simultaneously. The two cord wheels are disposed on the base rotatably and engaged with the two coil spring wheels respectively so that each of the cord wheels and the coil spring wheel with which the cord wheel is engaged can rotate simultaneously. Each of the two separation and reunion units is disposed adjacent to one of the cord wheels respectively and comprises an axle, at least two braking blocks, a separation and reunion wheel and at least two planetary gears. The axle is fixed on the base, and the two braking blocks are spaced apart and fixed on the base and are connected to the periphery of the axle so that a rolling groove is formed between the two braking blocks. The separation and reunion wheel has an axle hole and an inner ring gear adjacent to the axle hole. The axle hole is nested onto the axle rotatably, and the two braking blocks are surrounded by the inner ring gear. Each of the planetary gears is disposed within one of the rolling grooves rollably and engaged with the inner ring gear of the separation and reunion wheel so that each of the planetary gears can be driven by the inner ring gear of the separation and reunion wheel to be clamped to or separated from one of the braking blocks. Each of the two cords is winded onto one of the separation and reunion wheels respectively and an end of each of the two cords is fixed to one of the cord wheels so as to drive the separation and reunion wheel to rotate when the curtain body is being spread.

Accordingly, when the planetary gear is clamped to the inner ring gear of the separation and reunion wheel, the separation and reunion wheel cannot rotate, and in this case, the curtain body cannot be spread or folded so as to be located. When the planetary gear leaves the inner ring gear of the separation and reunion wheel, the separation and reunion wheel can rotate freely, and in this case, the curtain body can be spread.

DETAILED DESCRIPTION OF THE INVENTION

Figure 1:
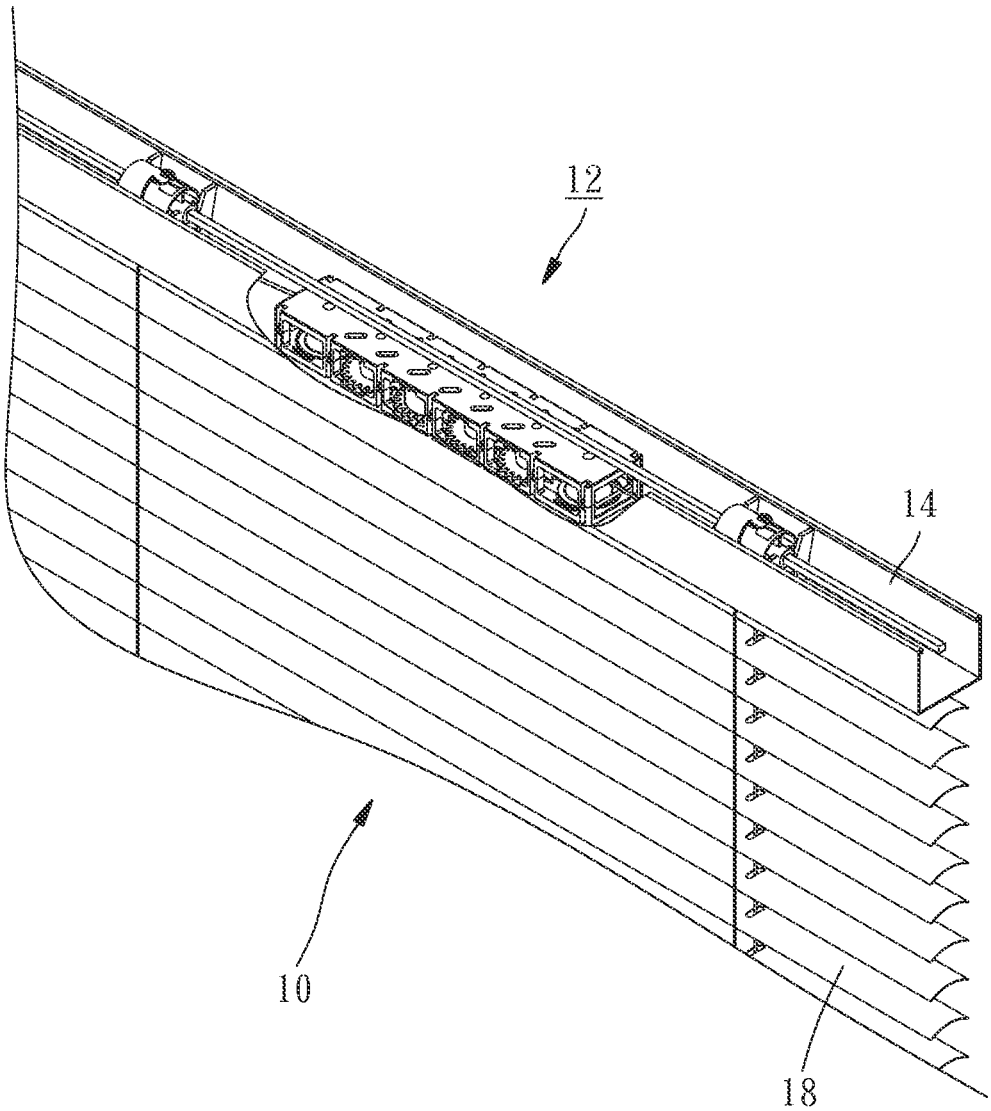
FIG. 1 is a perspective view of a curtain according to a first embodiment of the present invention.
Figure 2:
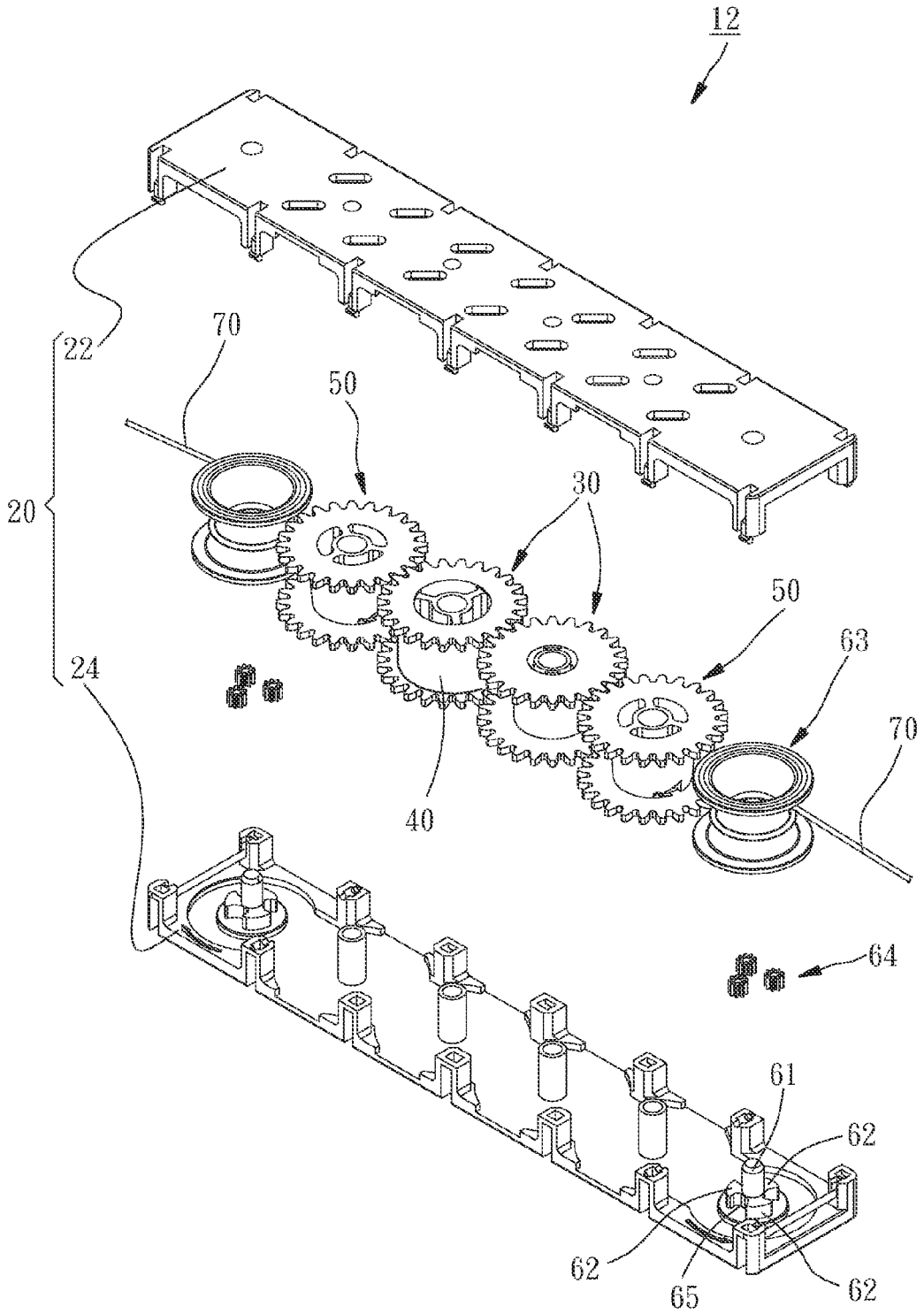
FIG. 2 is an exploded perspective view of the first embodiment of the present invention.
Figure 3:
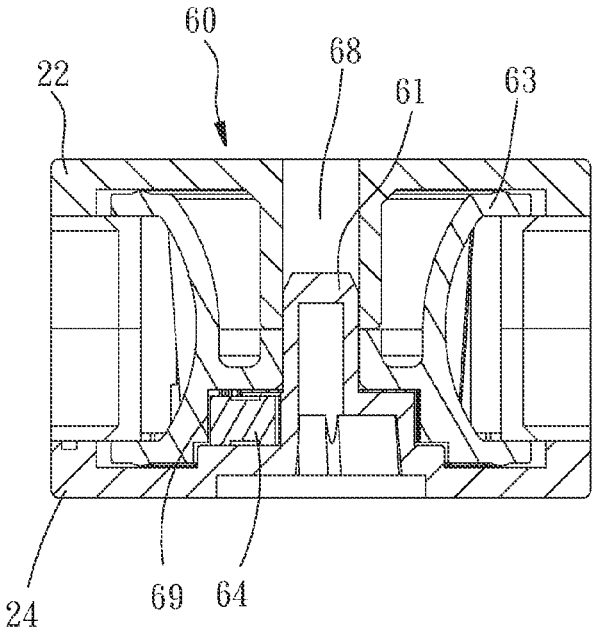
FIG. 3 is a cross-sectional side view of a separation and reunion unit according to the first embodiment of the present invention.
Figure 7:
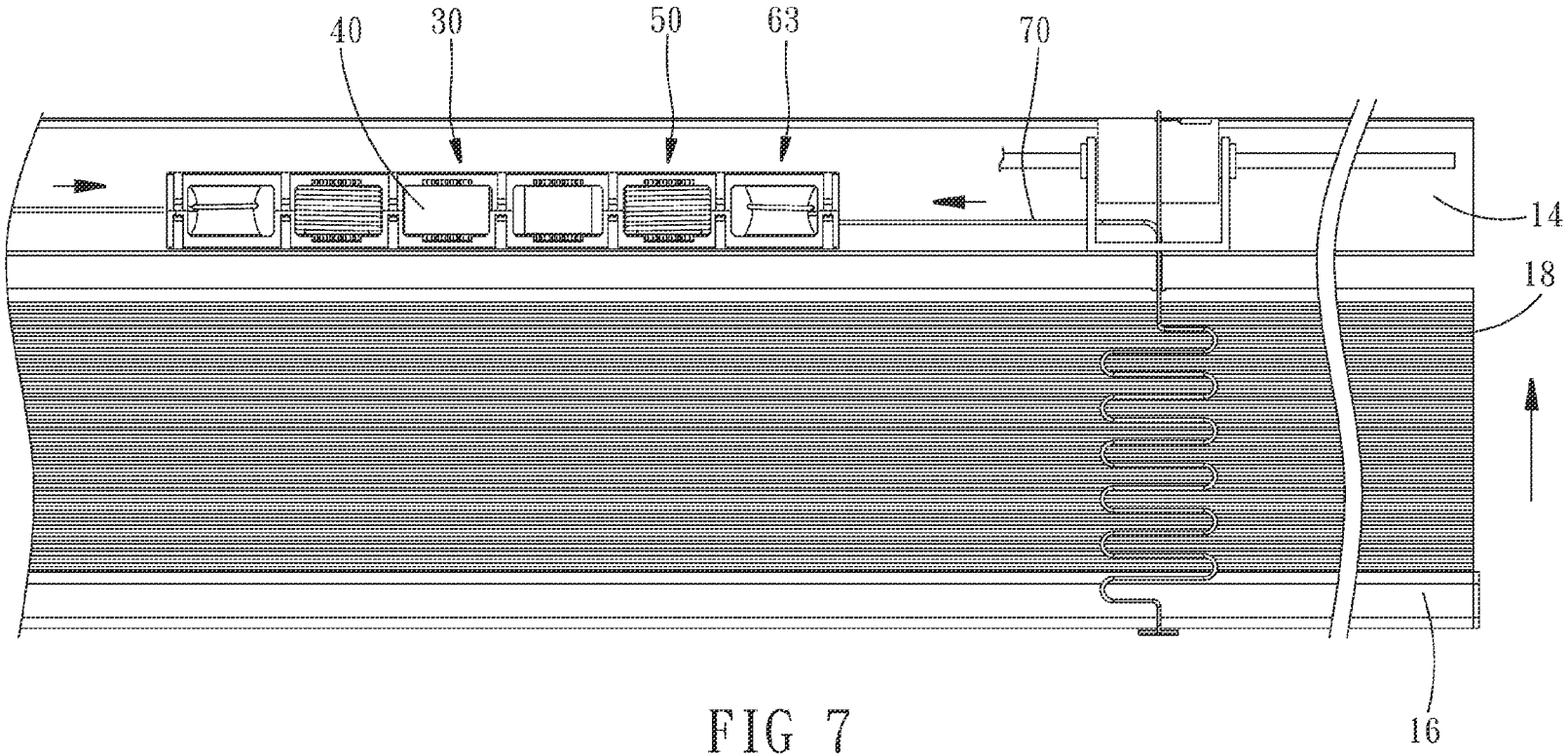
FIG. 7 is similar to FIG. 6 and mainly shows the curtain body in a folded state.

Referring to FIG. 1 and FIG. 7 firstly, a curtain body locating mechanism 12 of the present invention is mainly used in cooperation with a curtain 10 with no cord, and the curtain 10 with no cord shown in the figures comprises an upper beam 14, a lower beam 16 and a curtain body 18 disposed between the upper beam 14 and the lower beam 16. Next referring to FIG. 2 and FIG. 3, the curtain body locating mechanism 12 of the present invention comprises a base 20, two coil spring wheels 30, a coil spring 40, two cord wheels 50, two separation and reunion units 60 and two cords 70.

The base 20 is installed within the upper beam 14 and comprises a top plate 22 and a bottom plate 24.

The coil spring wheels 30 are disposed on the base 20 rotatably and engaged with each other.

Two ends of the coil spring 40 are connected to the coil spring wheels 30 respectively so that the two coil spring wheels 30 can rotate simultaneously through the coil spring 40.

Each of the cord wheels 50 is disposed on the base 20 rotatably and engaged with one of the coil spring wheels 30 respectively so that the cord wheel 50 and the coil spring wheel 30 with which the cord wheel 50 is engaged can rotate simultaneously.

Figure 4:
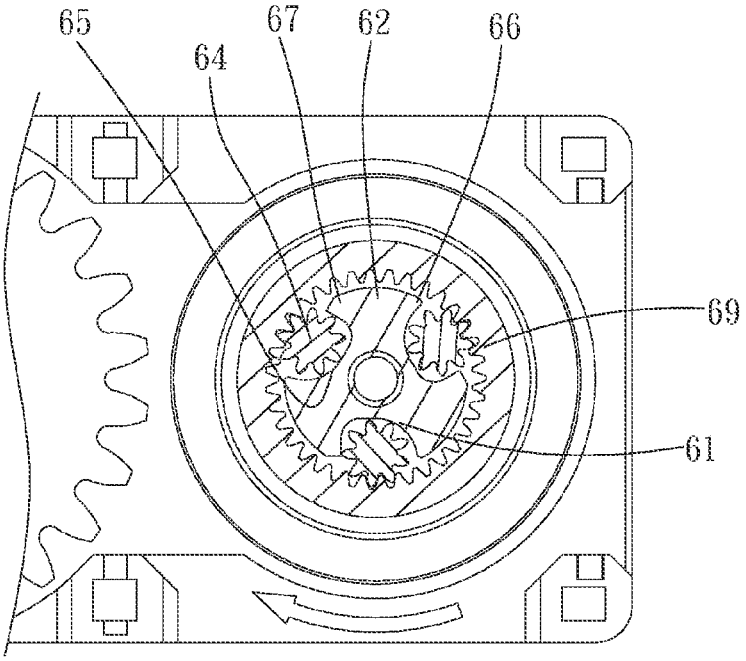
FIG. 4 is a top view of the separation and reunion unit of the first embodiment of the present invention and mainly shows that a planetary gear is clamped to a braking part of a braking block.
Figure 5:
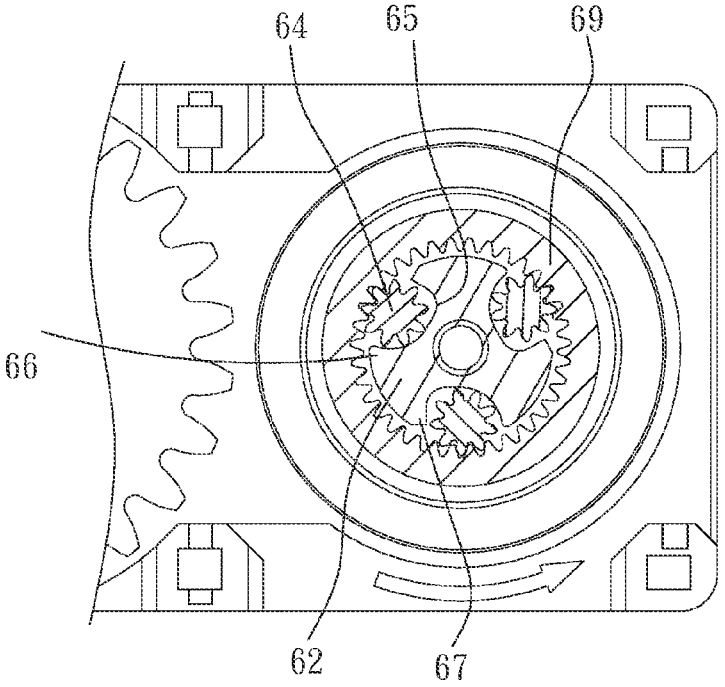
FIG. 5 is similar to FIG. 4 and mainly shows that the planetary gear reaches an adapting part of the braking block.

Each of the separation and reunion unit 60 is disposed adjacent to each of the cord wheels 50 and comprises an axle 61, three braking blocks 62, a separation and reunion wheel 63 and three planetary gears 64. The axle 61 is fixed on the bottom plate 24 of the base 20. The three braking blocks 62 are fixed on the bottom plate 24 of the base 20 and are connected to the outer periphery of the axle 61 at equal angles so that an rolling groove 65 is formed between every two adjacent braking blocks 62, wherein each of the rolling grooves is arc-shaped. As shown in FIG. 4 and FIG. 5, the curvature of one end of the rolling groove 65 is larger than the curvature of the other end of the rolling groove 65. Because the braking blocks adjacent to the two ends of each rolling groove 65 are different braking blocks 62, a braking part 67 and an adapting part 66 are formed at two ends of each braking block 62 respectively based on the curvature difference between the two ends of the rolling groove 65, and the curvature of the braking part 67 is larger than the curvature of the adapting part 66. The separation and reunion wheel 63 has an axle hole 68 and an inner ring gear 69 adjacent to the axle hole 68, and the separation and reunion wheel 63 is nested onto the axle 61 through the axle hole 68. After the separation and reunion wheel 63 is nested onto the axle 61, the braking blocks 62 are surrounded by the inner ring gear 69. The planetary gear 64 is disposed within the rolling groove 65 and engaged with the inner ring gear 69 of the separation and reunion wheel 63 so that the planetary gear 64 can be driven by the inner ring gear 69 of the separation and reunion wheel 63 to roll along the rolling groove 65 when the separation and reunion wheel 63 is rotating.

The separation and reunion wheel 63 is winded around by the cord 70 and two ends of the cord 70 are fixed to the lower beam 16 and the cord wheel 50 respectively so that the cord 70 can drive the separation and reunion wheel 63 and the cord wheel 50 to rotate simultaneously when the lower beam 16 is pulled down.

Figure 6:
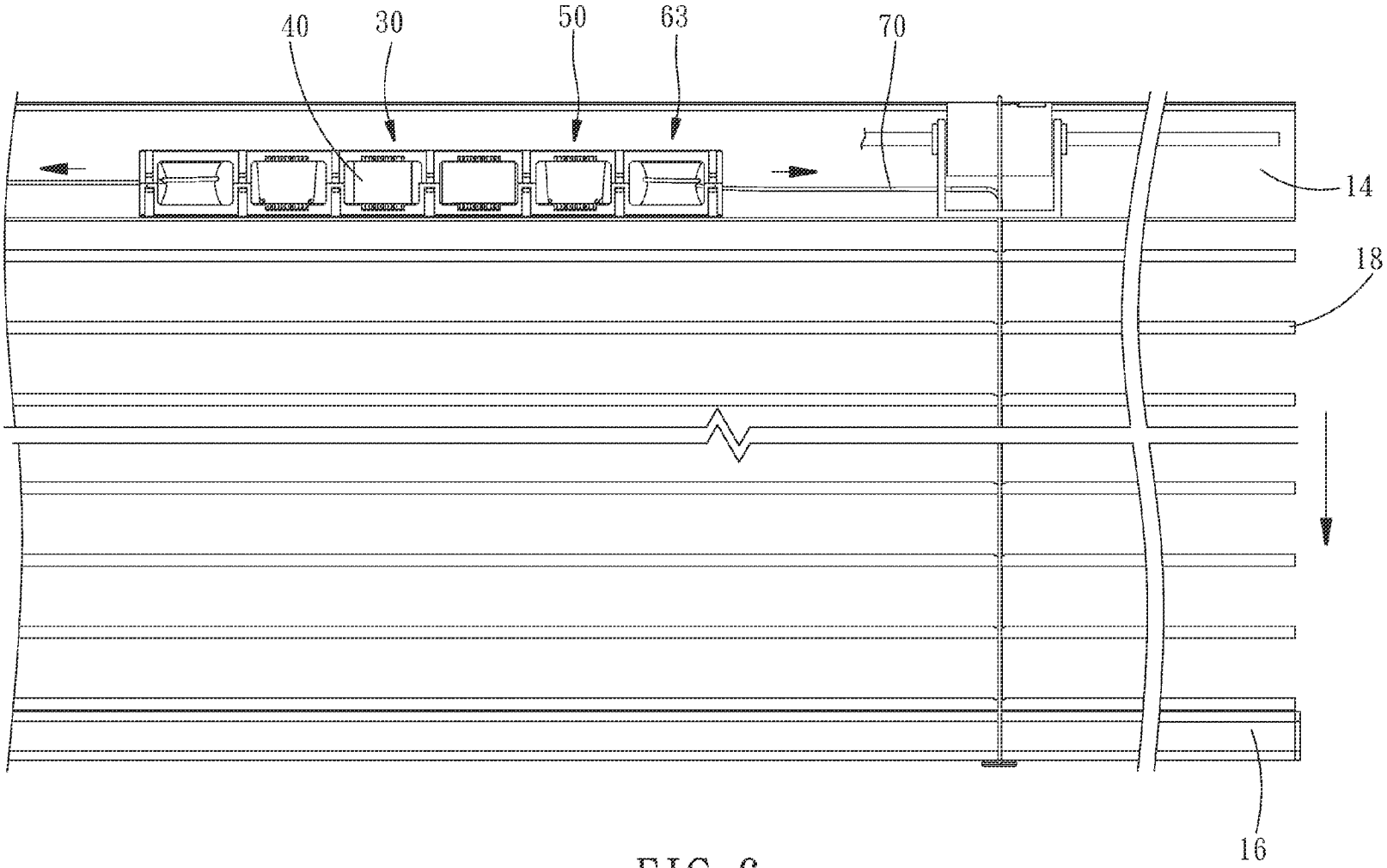
FIG. 6 is a front view of the curtain of the present invention and mainly shows a curtain body in a spread state.

When a user needs to spread the curtain body 18, as shown in FIG. 6, he/she firstly applies a force to pull down the lower beam 16 so that the cord 70 is stretched by the lower beam 16. When the cord 70 is stretched by the lower beam 16, the separation and reunion wheel 63 and the cord wheel 50 will be driven firstly to rotate. When the separation and reunion wheel 63 is rotating, as shown in FIG. 5, the separation and reunion wheel 63 utilizes the inner ring gear 69 thereof to drive the planetary gear 64 to roll along the rolling groove 65 to the adapting part 66 of the braking block 62. At this point, the planetary gear 64 idles so that the separation and reunion wheel 63 can be pulled by the cord 70 to rotate freely. On the other hand, the rotation of the cord wheel 50 will drive the coil spring wheel 30, with which the cord wheel 50 is engaged, to rotate so that the coil spring 40 is unwound from one coil spring wheel 30 and winded onto the other coil spring wheel 30 to accumulate its elastic restoring force.

Once the curtain body 18 has been spread to an appropriate position, the pulling force applied to the lower beam 16 is released. At this point, under the effect of the elastic restoring force of the coil spring 40, the coil spring wheel 30 will drive the cord wheel 50 to rotate slightly in the opposite direction. When the cord wheel 50 is rotating in the opposite direction, a small part of the cord 70 is winded onto the cord wheel 50 so that the separation and reunion wheel 63 can be pulled by the cord 70 to rotate slightly in the opposite direction. When the separation and reunion wheel 63 is rotating in the opposite direction, the separation and reunion wheel 63 utilizes the inner ring gear 69 thereof to drive the planetary gear 64 to roll along the rolling groove 65 to the braking part 67 of the braking block 62 so as to be clamped to the separation and reunion wheel 63, as shown in FIG. 4. As such, the planetary gear 64 will stop rotating, which will in turn make the separation and reunion wheel 63 stop rotating. In this case, the elastic restoring force of the coil spring 40 is offset by the frictional resistance between the cord 70 and the separation and reunion wheel 63 so that the curtain body 18 can remain spread.

When the user needs to fold the curtain body 18, as shown in FIG. 7, he/she firstly applies a force to push the lower beam 16 up so that the cord 70 is loosed to reduce the frictional resistance between the cord 70 and the separation and reunion wheel 63. In this case, the elastic restoring force of the coil spring 40 forces the two coil spring wheels 30 to rotate in opposite directions simultaneously with the aid of the pushing force of the user, and the rotation of the coil spring wheel 30 will in turn drive the cord wheel 50 to rotate so as to wind the cord 70 onto the cord wheel 50. After the curtain body 18 is completely folded together, the pushing force applied to the lower beam 16 is released so that the cord 70 is winded tightly onto the separation and reunion wheel 63 again. In this case, the elastic restoring force of the coil spring 40 is offset by the frictional resistance between the cord 70 and the separation and reunion wheel 63 so that the curtain body 18 can remain folded.

Figure 8:
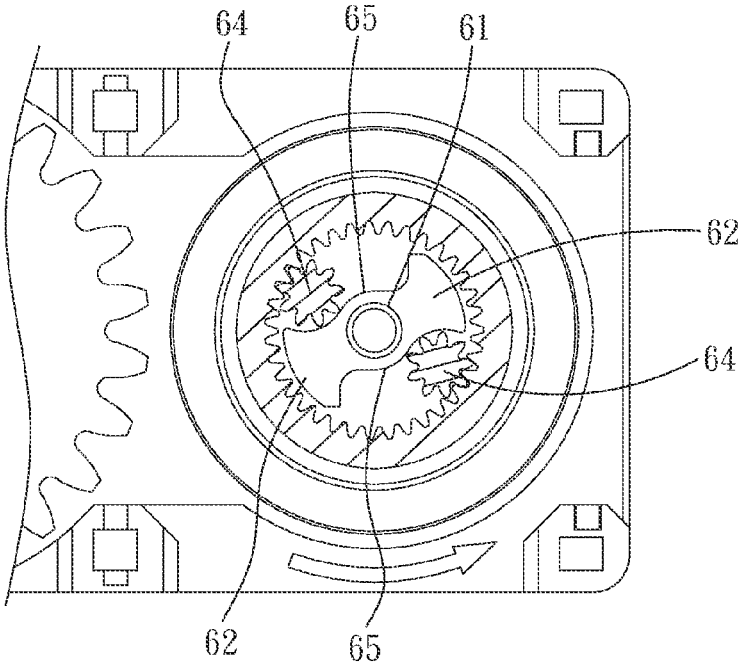
FIG. 8 is a cross-sectional top view of a separation and reunion unit according to a second embodiment of the present invention.

Furthermore, it shall be appreciated that, the present invention may have different varieties in structure. As shown in FIG. 8, the number of the braking blocks 62 is not necessarily to be three and it can be reduced to two depending on practical needs. In this case, the braking blocks 62 are connected to the outer periphery of the axle 61 symmetrically so that two rolling grooves 65 are formed between two ends of two different braking blocks 62 respectively. Each of the rolling grooves 65 has a planetary gear 64 disposed therein. Accordingly, when the separation and reunion wheel 63 is driven by the cord 70, the planetary gear 64 can also be driven to roll along the rolling groove 65 so that a separation and reunion effect can also be achieved between the planetary gear 64 and the braking block 62.

According to the above description, the curtain body locating mechanism 12 of the present invention utilizes the separation and reunion units 60 to provide the curtain body 18 with a good locating effect. Overall, the curtain body locating mechanism 12 has a simple structure and is stable in operation so that it can effectively prevent the curtain body 18 from rising again after being spread and sagging after being folded. In this way, the operation can be done more conveniently.

What is claimed is:

1. A curtain body locating mechanism for use in a curtain with no cord, comprising:

a base;

two coil spring wheels disposed on the base rotatably and engaged with each other;

a coil spring configured to connect the two coil spring wheels and optionally winded onto one of the coil spring wheels;

two cord wheels disposed on the base rotatably and engaged with the two coil spring wheels respectively;

two separation and reunion units disposed adjacent to the cord wheels respectively and each comprising an axle, at least two braking blocks, a separation and reunion wheel and at least two planetary gears, wherein the axle is fixed on the base, the two braking blocks are spaced apart and fixed on the base and are connected to the periphery of the axle so that a rolling groove is formed between the two braking blocks, the separation and reunion wheel has an axle hole and an inner ring gear adjacent to the axle hole, the axle hole is nested onto the axle rotatably, the two braking blocks are surrounded by the inner ring gear, and each of the planetary gears is disposed within one of the rolling grooves rollably and engaged with the inner ring gear of the separation and reunion wheel so that each of the planetary gears can be driven by the inner ring gear of the separation and reunion wheel to be clamped to or separated from one of the braking blocks; and two cords winded onto the separation and reunion wheels respectively and an end of each of the two cords being fixed to one of the cord wheels respectively.

2. The curtain body locating mechanism for use in a curtain with no cord of claim 1, wherein each of the rolling grooves is arc-shaped.

3. The curtain body locating mechanism for use in a curtain with no cord of claim 2, wherein for each of the rolling grooves, the curvature of one end thereof is larger than the curvature of the other end thereof so that a braking part and an adapting part are formed respectively at two ends of each of the braking blocks, the curvature of the braking part is larger than the curvature of the adapting part, the separation and reunion wheel cannot rotate when each of the planetary gears is clamped to the braking part of the braking block, and the separation and reunion wheel can rotate freely when each of the planetary gears reaches the adapting part of the braking block.

4. The curtain body locating mechanism for use in a curtain with no cord of claim 3, wherein each of the separation and reunion units comprises two braking blocks, and the two braking blocks are arranged symmetrically with the axle as a center.

5. The curtain body locating mechanism for use in a curtain with no cord of claim 3, wherein each of the separation and reunion units comprises three braking blocks, and the three braking blocks are arranged at equal angles with the axle as a center so that the rolling groove is formed between the every two adjacent braking blocks.

* * * * *